US006381862B1

(12) United States Patent
Doman

(10) Patent No.: US 6,381,862 B1
(45) Date of Patent: May 7, 2002

(54) HOLLOW GRINDER BEVEL ANGLE CONTROL MECHANISM

(76) Inventor: David Burke Doman, 3524 Crescent Hill Rd., Springfield, OH (US) 45502

( * ) Notice: Subject to any disclaimer, the term of this patent is extended or adjusted under 35 U.S.C. 154(b) by 0 days.

(21) Appl. No.: 09/459,210

(22) Filed: Dec. 10, 1999

(51) Int. Cl.[7] ..... B24B 25/00; B24B 27/00

(52) U.S. Cl. ..... 33/630; 33/613; 33/641; 451/380; 451/234

(58) Field of Search ..... 33/613, 626, 628, 33/641, 643, 1 N, 424, 456, 471, 534, 455, 630; 451/367, 380, 387, 405, 234, 229

(56) References Cited

U.S. PATENT DOCUMENTS

| | | | | |
|---|---|---|---|---|
| 40,838 A | * | 12/1863 | Hendrick | 451/380 |
| 976,927 A | * | 11/1910 | Rundel | 451/367 |
| 2,562,618 A | * | 7/1951 | Keller | 451/367 |
| 3,800,117 A | * | 3/1974 | Anderson | 219/69 V |
| 4,142,331 A | | 3/1979 | MacJannette | |
| 4,607,459 A | | 8/1986 | Rees | |
| 4,881,347 A | * | 11/1989 | Mario et al. | 451/213 |
| 5,172,484 A | | 12/1992 | Triola | |

* cited by examiner

*Primary Examiner*—Diego Gutierrez
*Assistant Examiner*—Madeline Gonzalez
(74) *Attorney, Agent, or Firm*—Mark A. Navarre

(57) ABSTRACT

An improved hollow grinder bevel angle control wherein a height-attitude coupling mechanism links the height and attitude motions of an adjustable tool-rest, and a scale on a stationary portion of the grinder cooperates with a pointer on the height-attitude coupling mechanism to indicate a relationship between bevel angle and grinding wheel radius. The coupling mechanism is implemented with a linkage mechanism that provides a wide range of tool-rest adjustment, subject to the height-attitude relationship defined by the linkage. The pointer is mounted for rotation with the linkage mechanism about its fixed pivot point, and is user-adjustable so that a dimension from the fixed pivot point to the tip of the pointer coincides with the radius of the grinder wheel. The bevel angle scale is stationary with respect to movement of the linkage mechanism, and arranged so that the tip of the pointer sweeps across the scale as the linkage mechanism is adjusted through its full range of movement. The indicia on the scale reflect the height-attitude relationship defined by the linkage mechanism, such that the indicia coinciding with the tip of the pointer denotes the achieved bevel angle. A tool-rest lock mechanism selectively couples the linkage mechanism to the grinder housing to maintain a selected heigh/attitude relationship.

10 Claims, 8 Drawing Sheets

HOLLOW GRINDER BEVEL ANGLE CONTROL MECHANISM

TECHNICAL FIELD

This invention pertains to hollow grinding machines, and more particularly to a mechanism for easily and accurately controlling the bevel angle of the grinder.

BACKGROUND OF THE INVENTION

Hollow grinders are commonly used for sharpening tool blades, and typically include a tool-rest for maintaining a desired orientation of the blade relative to the grinding wheel. This orientation determines the grinding angle (or bevel angle) with respect to the longitudinal axis of the tool blade.

The tool-rest is typically adjustable with two or more degrees of freedom to facilitate adjustment of the height and attitude of the tool blade, while maintaining a proper air gap between the tool-rest and the grinding wheel to prevent operator injury. Simultaneously achieving a desired bevel-angle and air-gap can be both difficult and time consuming, and most hollow-grinding machines have no mechanism for determining the bevel angle that will be achieved with a given height-attitude setting. The problem is exacerbated by the fact that the bevel angle not only varies with height-attitude setting, but also with grinding wheel radius, which decreases with use. Thus, the bevel angle obtained for a particular height-attitude setting on one wheel will be different if the tool is ground on a wheel of different radius. Accordingly, what is desired is a hollow grinder with a bevel angle control that is easily adjustable and that provides accurate bevel angle control despite variations in grinding wheel radius.

SUMMARY OF THE INVENTION

The present invention is directed to an improved hollow grinder bevel angle control wherein a height-attitude linkage mechanism restricts the height and attitude motions of an adjustable tool-rest to a prescribed relationship, and a scale on a stationary portion of the grinder cooperates with a pointer on the height-attitude linkage mechanism to indicate a relationship between achieved bevel angle and grinding wheel radius. According to the invention, the linkage mechanism is implemented with a stationary link and three movable links, defining a parallelogram. The first and second movable links are rotatable about fixed pivot points at one end, and the third movable link is coupled to the other (free) ends of the first and second movable links. The fixed pivot point for the first movable link is co-axial with the grinding wheel, and the tool-rest is supported on a shaft coupling the first and third links. The tool-rest is mounted for slidable adjustment parallel to the longitudinal axis of the first link to permit adjustment of the gap between the tool-rest and the periphery of the grinder wheel.

The pointer is mounted for rotation with the first link about its fixed pivot point, and is user-adjustable so that the distance from the fixed pivot point to the tip of the pointer coincides with the radius of the grinder wheel. The bevel angle scale is stationary with respect to movement of the linkage mechanism, and arranged so that the tip of the pointer sweeps across the scale as the linkage mechanism is adjusted through its full range of movement. The indicia on the scale reflect the height-attitude relationship defined by the linkage mechanism, such that the indicia coinciding with the tip of the pointer denotes the achieved bevel angle. A tool-rest lock mechanism selectively couples the linkage mechanism to the grinder housing to maintain a selected height/attitude relationship.

With the above-described apparatus, achieving a desired bevel angle merely involves adjusting the pointer length based on grinding wheel radius, raising or lowering the tool-rest via the linkage mechanism until the pointer tip coincides with the corresponding indicia on the bevel angle scale, and then locking the tool-rest in place with the tool-rest lock mechanism.

DESCRIPTION OF THE PREFERRED EMBODIMENT

Figure 1:
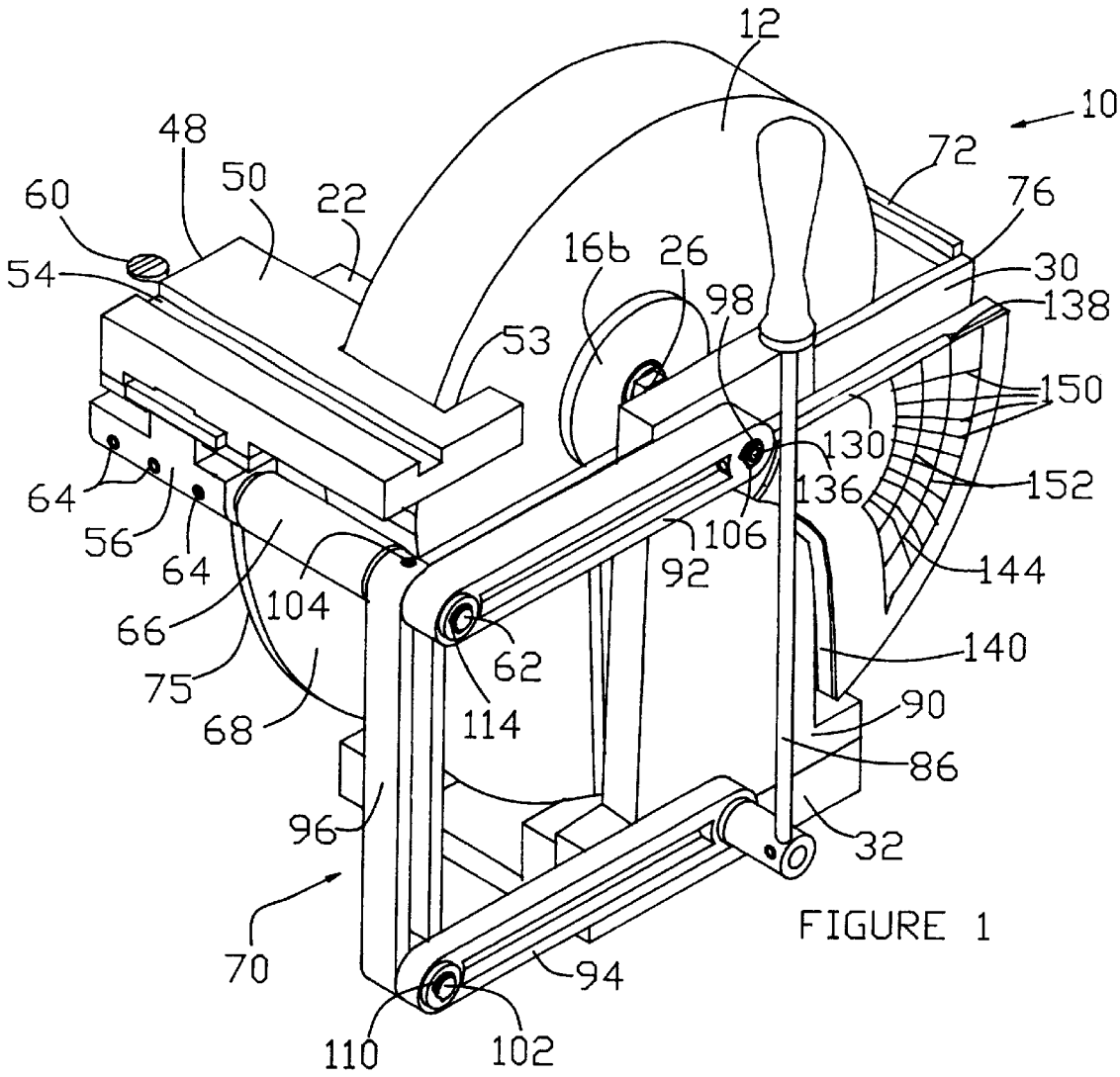
FIG. 1 is an isometric view of a hollow bevel grinder according to this invention, having a height-attitude linkage mechanism, a tool-rest lock mechanism, and an iso-bevel angle scale.
Figure 2:
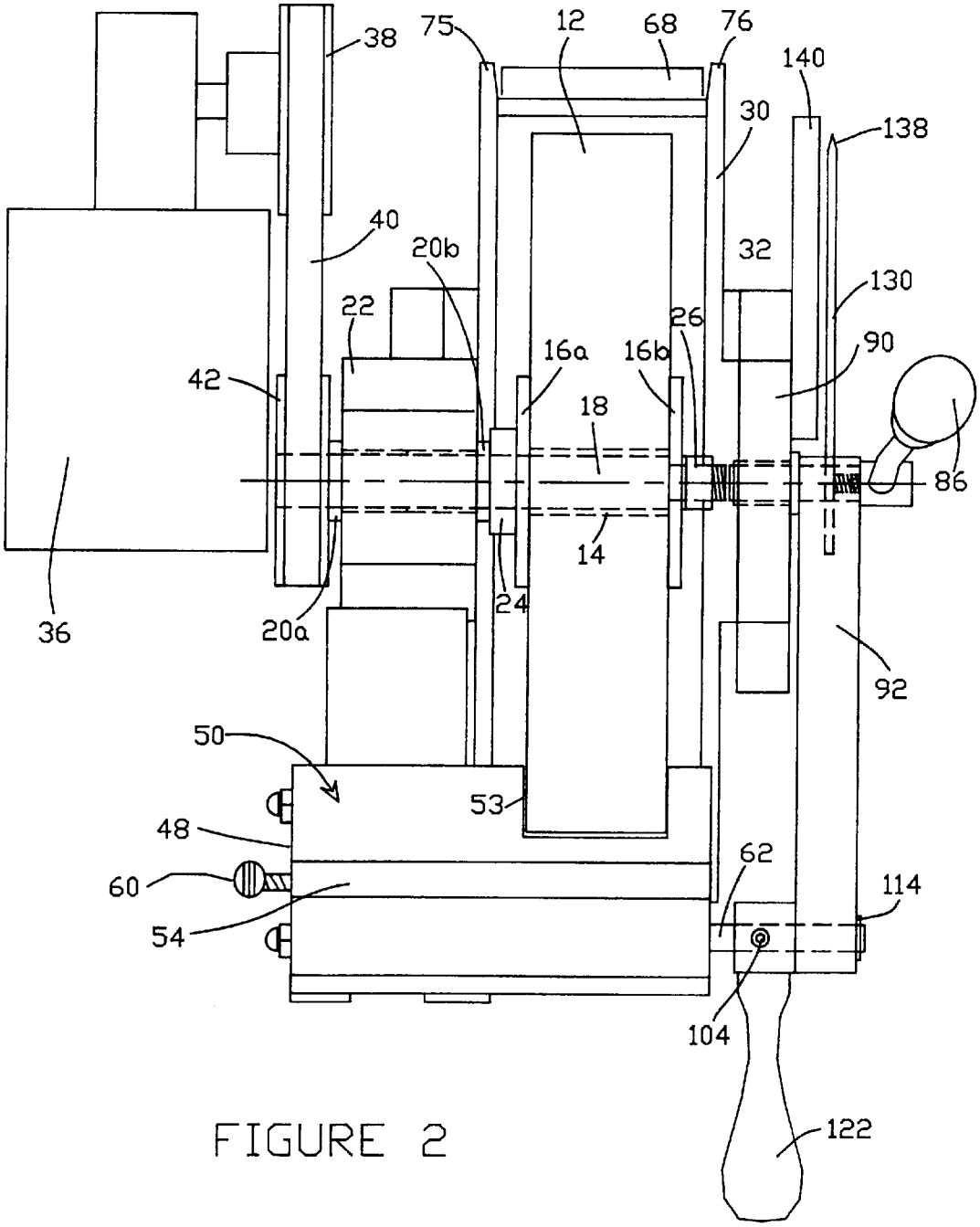
FIG. 2 is a top view of the grinder of FIG. 1.

Referring to the drawings, and particularly to FIGS. 1–3 and 6, the reference numeral 10 generally designates a hollow bevel grinder according to this invention. The grinding wheel 12 has a bushing 14 pressed into a central axial opening thereof, and a pair of washer bushings 16*a*, 16*b* on either side thereof. A spindle 18 passes through the washer bushings 16*a*, 16*b*, supporting the wheel 12 for rotation about the spindle axis. The spindle 18, in turn, is supported on a pair of flange bushings 20*a*, 20*b* mounted in a spindle support member 22. A set-screw collar 24 defines an axial gap between the wheel 12 and the support member 22, and a nut and washer 26 fastened onto the opposite end of spindle 18 clamps the washer bushing 16*a* against the collar 24, fixing the axial position of the wheel 12. An arcuate trough 30, fixed to the spindle support member 22, envelopes a lower portion of the wheel 12, and may contain water or another suitable fluid for cooling and clog prevention.

Figure 3:
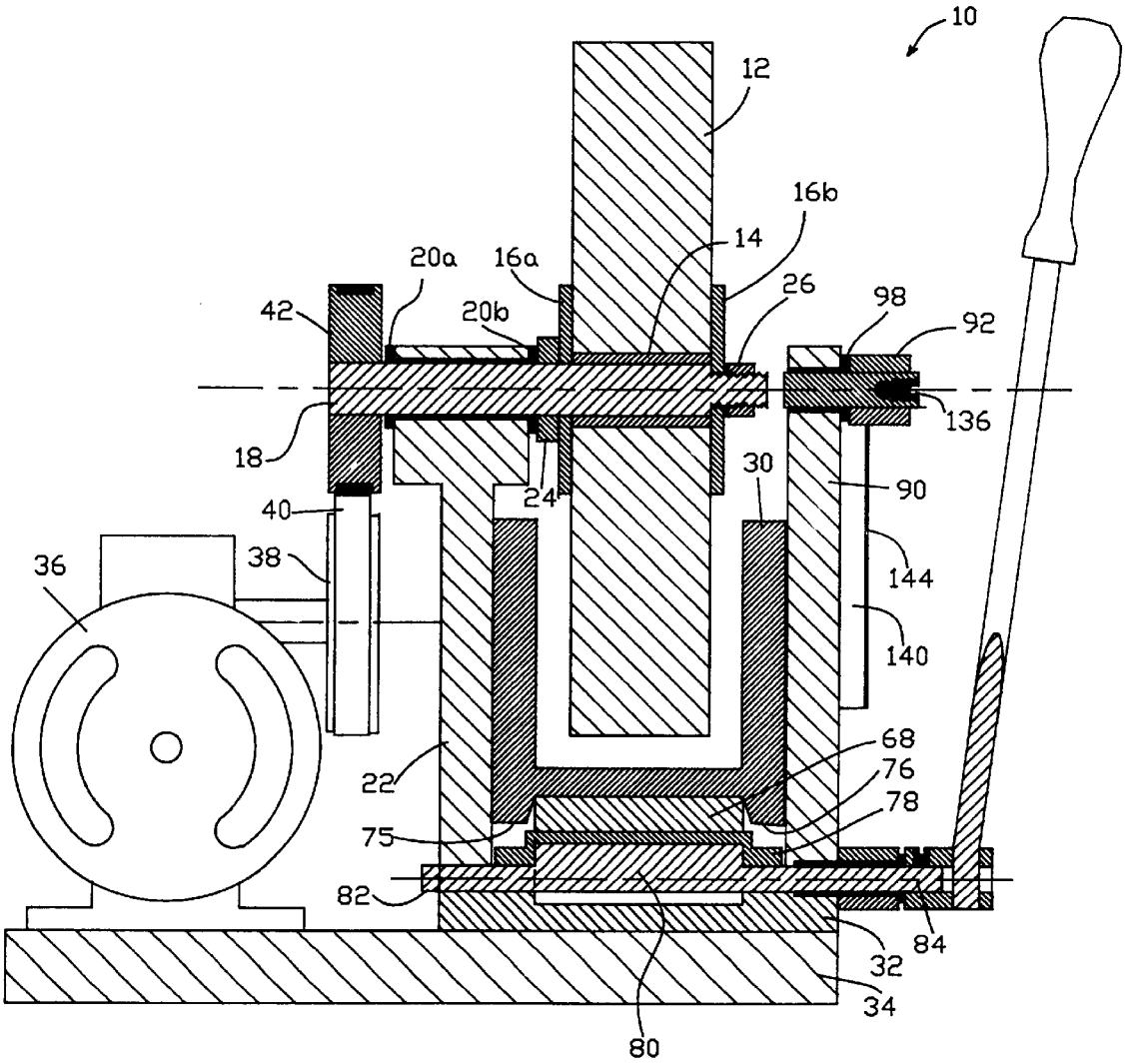
FIG. 3 is an end view of the grinder of FIG. 1, sectioned through the axis of the grinding wheel.

As best seen in FIG. 3, the spindle support member 22 is mounted on a base member 32, which in turn, is mounted on a grinder platform 34. An electric motor 36, also mounted on the platform 34, is geared to rotate a drive pulley 38, which is coupled via belt 40 to a pulley 42 fixed on the end of spindle 18. Motor 36 operates at a fixed speed, and the pulleys 38, 42 are relatively sized to drive the wheel 12 at a suitable speed, such as 90 RPM. The grinding wheel 12 should rotate away from the operator when cooled by water to prevent water from deflecting off of the top of the tool and onto the operator. Nut 26 and spindle 18 should have right-hand threads for clockwise grinding wheel rotation to prevent loosening with use.

Figure 6:
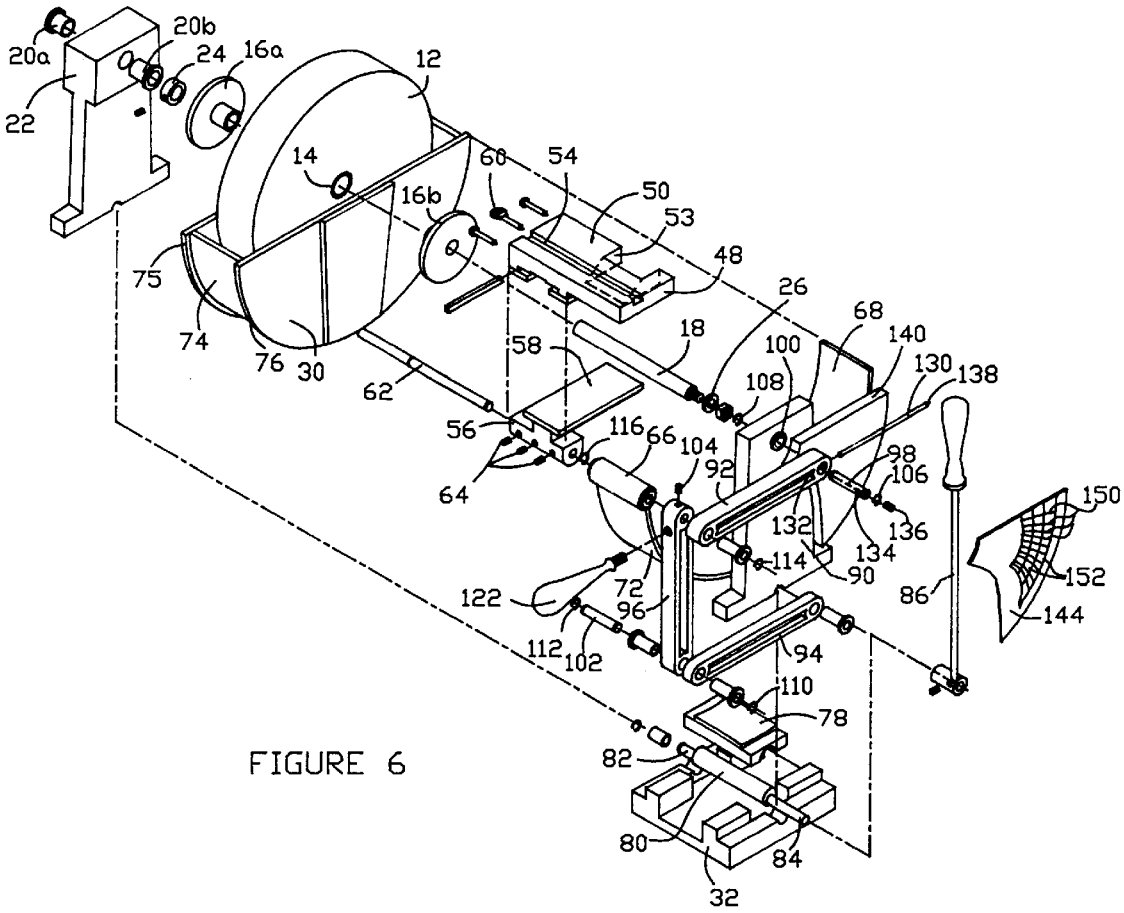
FIG. 6 is a partial exploded view of the grinder of FIG. 1.

A tool-rest 48 has an upper surface 50 for supporting a tool or other article to be ground by wheel 12. A grinding wheel opening 53 receives the wheel 12, and the hidden portion of opening 53 may be contoured to prevent said tool-rest bottom from coming into contact with wheel 12 when grinding shallow tool bevels, as shown in FIG. 6. The contour is determined by the desired minimum bevel-angle of grinder 10, the grinding wheel diameter and the desired distance (typically, 1/16 inch) between the front edge of said grinding wheel opening 53 and wheel 12. Finally, a tool-rest guide groove 54 is provided as a miter gauge slot to assist in grinding bevels on skewed tools.

Tool-rest 48 is mounted on a tool-rest support member 56, with a box slide interface, generally designated by the reference numeral 58, that permits adjustment of the spacing between tool-rest 48 and wheel 12 without changing the relative orientation of the tool-rest 48 and wheel 12. A gib clamp screw 60 is provided for locking the position of tool-rest 48 relative to support member 56 when the tool-rest 48 is positioned as desired.

Figure 5:
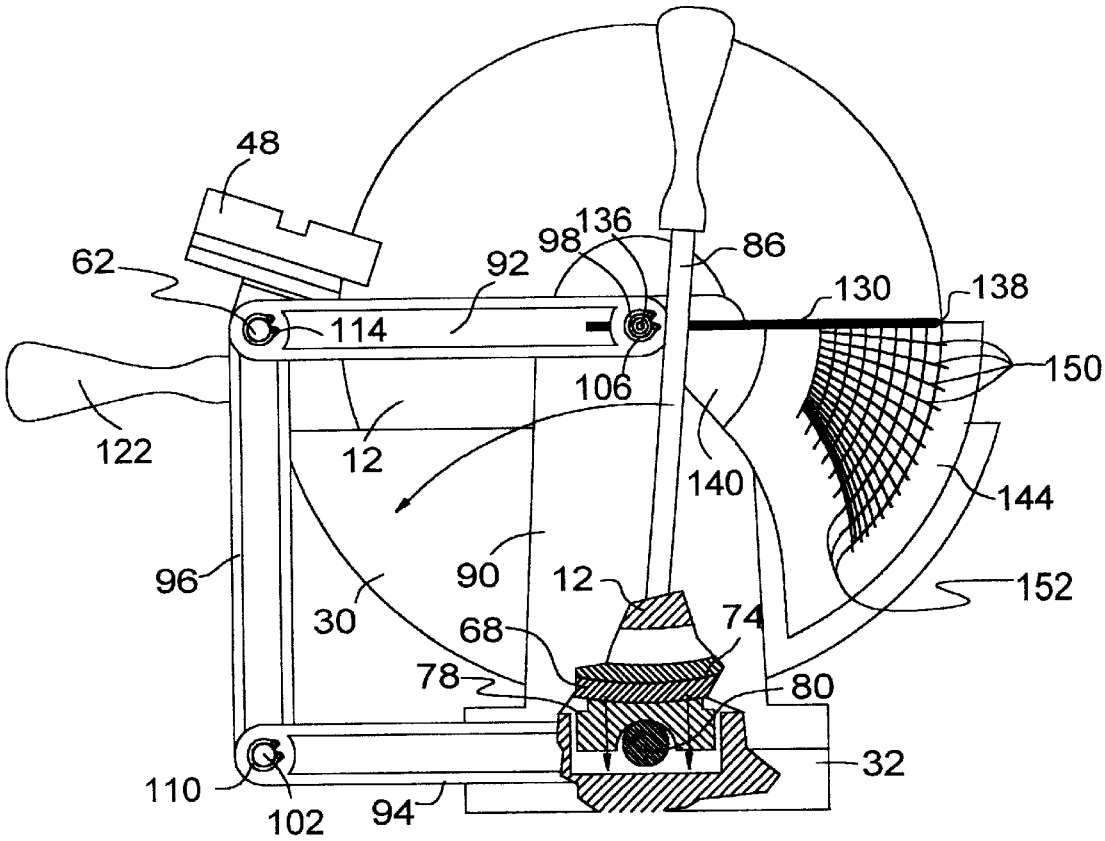
FIG. 5 is a side-view of the grinder of FIG. 1, sectioned in part to illustrate operation of the tool-rest lock mechanism.

The tool-rest support member 56 is mounted on a shaft 62 and rigidly secured thereon by one or more set-screws 64. The portion of shaft 62 extending from support member 56 passes through a cylindrical portion 66 of a tongue 68 and is supported by a linkage mechanism 70, which is described in detail below. A ring portion 72 of tongue 68 is contoured to match the exterior contour of arcuate trough 30, and the ring portion 72 is laterally retained within a groove 74 defined by a pair of ridges 75, 76 formed on the exterior periphery of trough 30. The tongue 68 is further maintained in position relative to the trough 30 by a clamp pad 78 disposed between the ring portion 72 and an eccentric cam 80, as illustrated most clearly in FIG. 5. The cam 80, in turn, is supported for rotation within the base member 32 on camshafts 82, 84. A user operated handle 86 is rigidly secured to the camshaft 84 to facilitate user rotation of the cam 80 for selectively raising and lowering the clamp pad 78 for respectively locking and unlocking the tongue 68 relative to the trough 30. Due to the aforementioned connection between shaft 62 and the cylindrical portion 66, the tongue 68 serves as a coupling for locking and unlocking the tool-rest 48 and linkage mechanism 70.

The linkage mechanism 70 includes a stationary linkage support member 90 mounted on the base member 32, and first, second and third movable links 92, 94 and 96. A linkage pin 98 rotatably couples the first (upper) link 92 to a flange bushing 100 mounted in support member 90 that is coaxial with the grinder wheel 12. The second (lower) link 94 is coupled to the camshaft 84, and the third (vertical) link 96 is coupled between the movable ends of first and second links 92 and 94. The second and third links 94, 96 are coupled via linkage pin 102, whereas the first and third links are coupled via shaft 62. Rotation of the shaft 62 with respect to the third link 96 is prevented by the set-screw 104. The links 92, 94, 96 are free to rotate at each point of coupling, and snap rings 106–116 may be used to secure the links 92, 94, 96 on the respective pins 98, 102 and shaft 62, as shown in the exploded view of FIG. 6.

The links 92, 94 and 96 are sized so that the linkage mechanism resembles a parallelogram. Thus, the first and second links 92, 94 are essentially identical, and the third link 96 has an effective length (between pivot points) that corresponds to the distance between the centers of cam shaft 84 and flange bushing 100. Also, the effective length of the first and second links 92, 94 is equal to the mean radius of the ring portion 72 of tongue 68 since the tool-rest 48 is coupled to the cylindrical portion 66. Finally, the effective length of the third link 96 (and hence, the distance between camshaft 84 and flange bushing 100) should be at least as great as the effective length of the first and second links 92, 94 in order to avoid interference between the first and second links 92, 94. A handle 122 is affixed to the third link 96, and the user can move the handle up or down to rotate the first and second links 92, 94 in a plane parallel to the front face of linkage support member 90, while the third link 96 remains perpendicular to the grinder platform 34. Linkage sticking points caused by all members being collinear are never reached because all bevel-angles between 0 degrees and 90 degrees can be obtained by setting the first and second links 92, 94 to an angle less than 90 degrees with respect to the grinder platform 34.

Figure 4A:
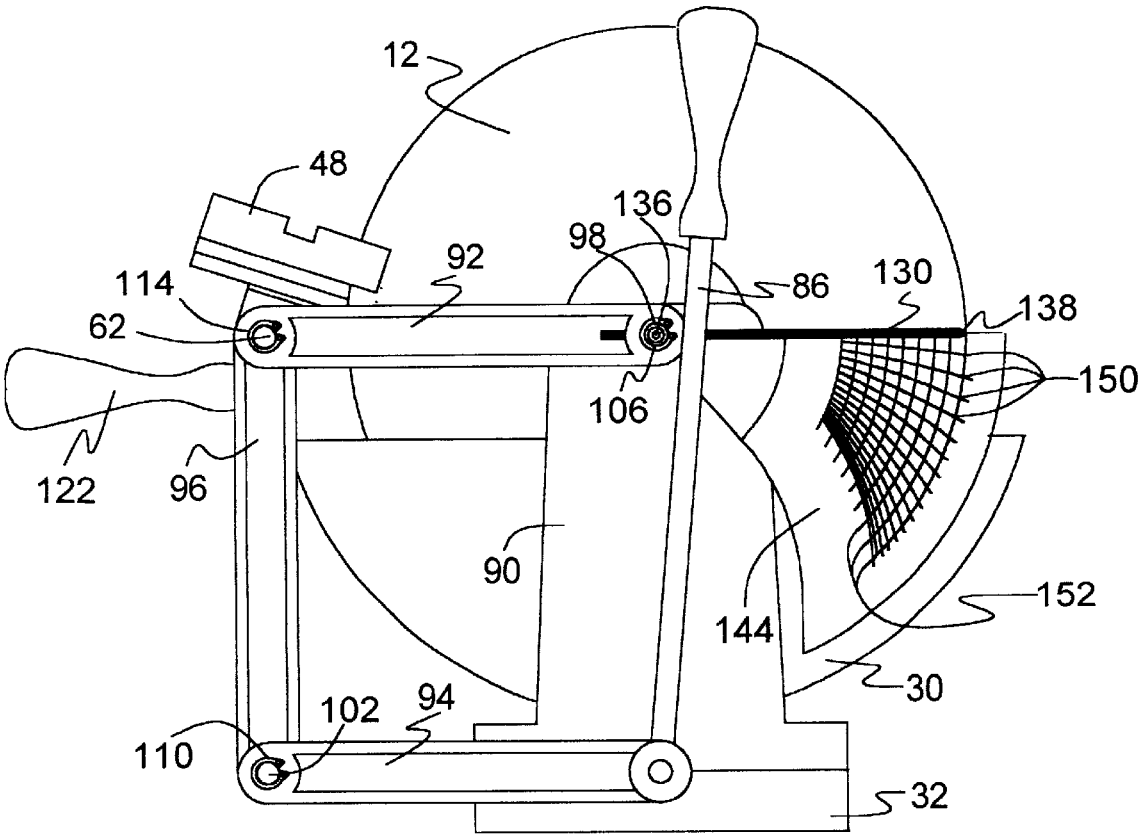
FIGS. 4A and 4B are side views of the grinder of FIG. 1, illustrating different positions of the height-attitude linkage mechanism.
Figure 4B:
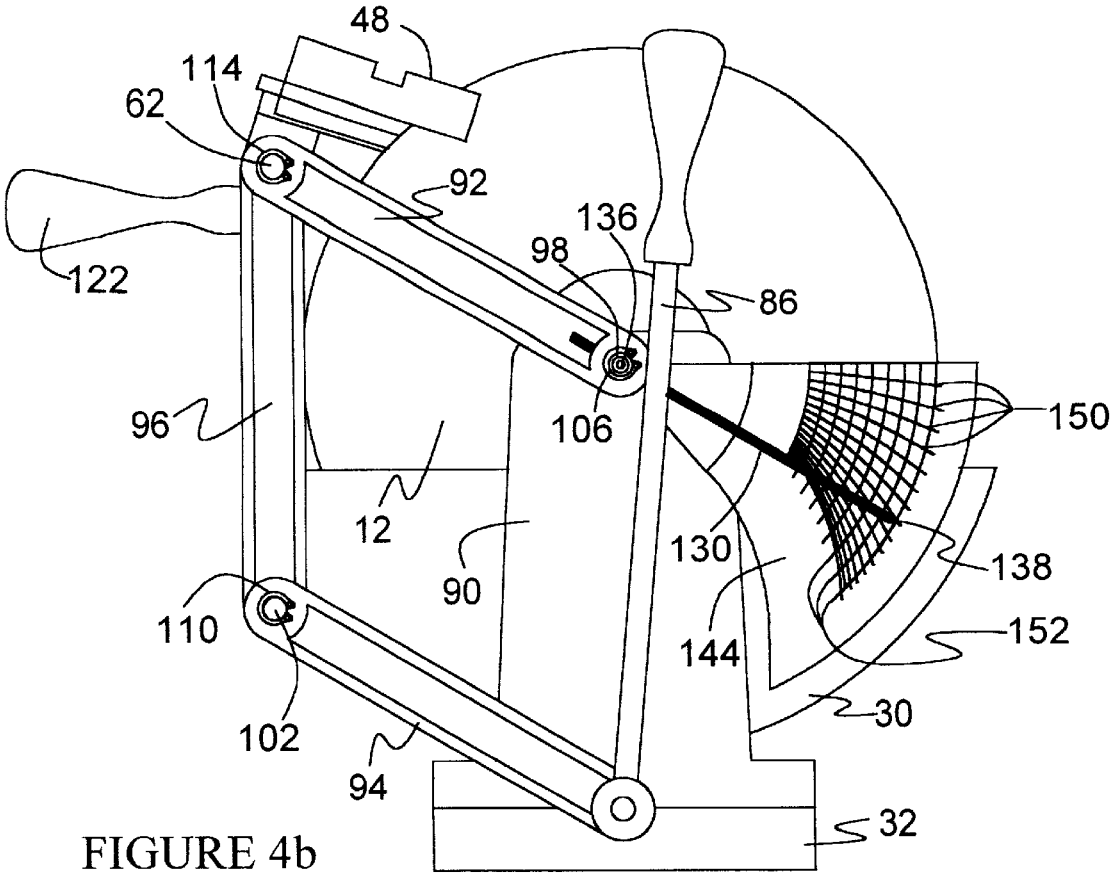

FIGS. 4A and 4B depict the linkage mechanism 70 in two different positions, providing grinding bevel angles of 90 degrees and 50 degrees, respectively. It will be seen that the third link 96 remains perpendicular with respect to the base member 32, so that the attitude of the tool-rest upper surface 50 with respect to the base member 32 remains unchanged even though its height above base member 32 changes.

From the above description, it will be seen that the linkage mechanism 70 serves to couple the height and attitude of the tool-rest 48 in a prescribed relationship while maintaining the tool-rest support member 56 at a fixed distance from the axis of wheel 12. A pointer 130 passes through the fixed pivot point of first link 92 and serves as a linkage position indicator. As shown in FIG. 6, the pointer 130 passes through openings 132, 134 in link 92 and linkage pin 98. A set-screw 136 threaded into the exposed end of linkage pin 98 can be tightened or loosened to secure or release the pointer 130 for translation along its axis. In use, the extension of pointer 130 is adjusted to correspond to the radius of wheel 12 so that the tip 138 of pointer 130 circumscribes an arc segment corresponding to the wheel radius. See FIGS. 4A and 4B, where the wheel diameter is 10 inches, and the length of pointer 130 has been adjusted accordingly.

A scale plate 140 rigidly fastened to the linkage support member 90 is disposed between the pointer 130 and a scale 144 is affixed to the scale plate 140 so that the user can identify a point on the scale 144 corresponding to the position of the pointer tip 138. Scale 144 is printed or engraved with a series of contour lines 150 representing lines of constant bevel-angle (i.e., iso-bevel lines) and a series of arc lines 152 that are concentric with linkage pin 98.

Figure 7:
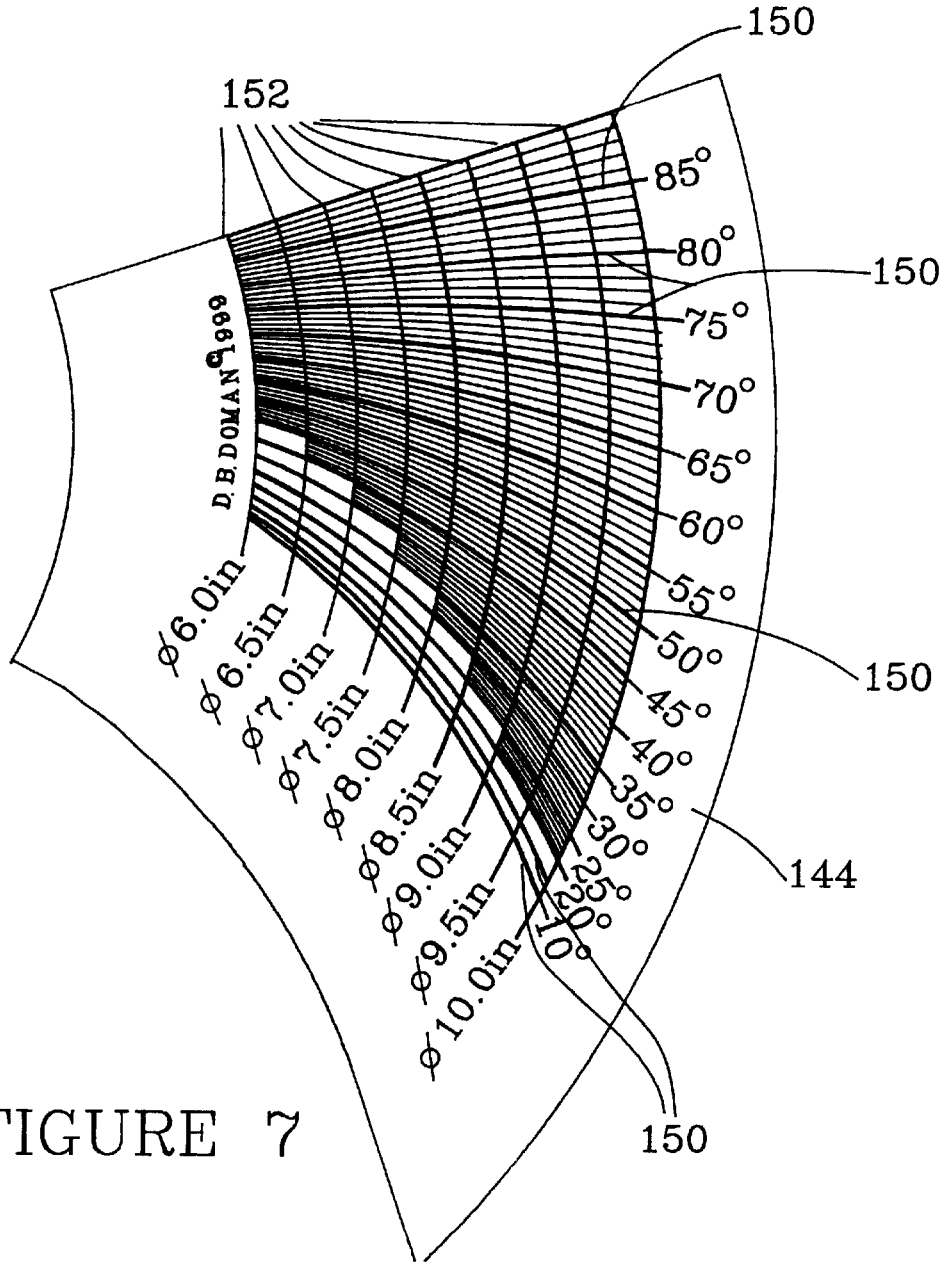
FIG. 7 is an enlarged diagram of the iso-bevel angle scale on the grinder of FIG. 1.

FIG. 7 shows an example of an iso-bevel scale 144 with contour lines 150 ranging from 10 degrees to 90 degrees and arc lines 152 with radii ranging from 3 inches to 5 inches in 1/4 inch increments.

When the pointer 130 has been adjusted in accordance with the wheel radius as described above, a desired bevel angle is achieved by adjusting the linkage mechanism 170 until the pointer tip 138 intersects the corresponding iso-bevel line 150. Stated another way, the intersection of an iso-bevel contour line 150 with an arc line 152 of radius equal to that of grinding wheel 12 indicates the position that the pointer tip 138 must occupy to obtain the bevel-angle corresponding to the respective contour line 150, when the distance from the centerline of linkage pin 98 to the pointer tip 132 is equal to the radius of wheel 12. The tool being ground must be placed flat on the top surface 50 of tool-rest 48 to ensure that an accurate bevel-angle is achieved. The iso-bevel contour lines 150 can be constructed geometrically or by plotting the level curves of the equation:

$$\beta(x, y) = \arcsin\left\{\left[\frac{a(x, y)}{r(x, y)}\right]\sin\left(\arcsin\left[\frac{y}{r(x, y)}\right] + \arcsin\left[\frac{\frac{-x\delta y}{r(x, y)}}{a(x, y)}\right]\right)\right\} - 90°$$

where β is the bevel-angle and x, y are Cartesian coordinates whose origin is located at intersection of the centerlines of pointer 130 and linkage pin 98. The perpendicular distance between the longitudinal axis of said tool-rest support shaft 62 and the upper surface 50 of tool-rest 48 is denoted by the variable δ. The function $r(x, y)=\sqrt{x^2+y^2}$ is the radial distance from the origin of the x, y plane to the coordinates x, y at which the bevel-angle is to be calculated, and corresponds to the point of intersection between the centerline of linkage member 92 and the projection of the grinding wheel periphery onto such centerline. Since the tool-rest 48 and scale 144 are on opposite sides of the linkage member 92, the iso-bevel contours must be calculated at (−x, −y) in order to reflect the 180° offset. The function a (x, y) is simply an intermediate term used to write the equation in compact form, and is defined as follows:

$$a(x, y) = \delta y^2 + R^2 + 2R\delta y\frac{y}{\sqrt{x^2 + y^2}}$$

In FIGS. 4A and 4B, it can be seen that the tool rest is inclined with respect to base member 32. With such inclination, the 90° iso-bevel contour falls on a line parallel to base member 32, as shown. Of course, other inclination angles are also possible, but it is generally desirable to configure the contour lines as shown. In any event, the angle of inclination for any given value of x may be determined by setting β equal to 90°, solving for y, and calculating the inclination angle i from:

$$i=\text{arcian}\ (y_{90}/x_{90})$$

where $(x_{90}, y_{90})$ designates any point that lies on the 90° iso-bevel contour line.

Iso-bevel contours can be generated by numerical analysis and gridding software and the result imported into computer aided drafting software where labels may be applied. The CAD software can then be used to write plotter or computer numerical control (CNC) code that can be used to directly engrave the image onto scale 144. The scale can also be photo-etched onto a brass or copper plate.

To summarize, achieving a desired grinding bevel angle with the bevel angle control mechanism of this invention simply involves adjusting the pointer 130 in accordance with the wheel radius, adjusting the linkage mechanism until the pointer tip 138 intersects the contour line 150 corresponding to the desired bevel angle, and rotating the handle 86 clockwise to lock the tool-rest 48 in position. Adjustment of the pointer 130 may be conveniently achieved without direct measurement by placing a straightedge against the grinding wheel surface in vicinity of the pointer tip 138, and extending or retracting pointer 130 until it touches the straight edge.

In the manner described above, the bevel angle control mechanism of this invention enables the user to rapidly and accurately position the tool-rest 48 such that a prescribed tool bevel-angle will be obtained when a tool is placed flat on the tool-rest surface 50 and brought into contact with the periphery of grinding wheel 12. The tool-rest height and attitude with respect to the grinding wheel tangent lines are uniquely defined by the angular position of the parallelogram linkage mechanism 70, thereby eliminating problems associated with the height-attitude coupling effect on bevel-angle. The position of the linkage mechanism 70 is identified by the pointer 130, and adjustment of its length based on grinding wheel radius allows a desired bevel angle to be achieved simply by aligning the pointer tip 138 with the corresponding contour line 150 of constant bevel-angle.

While the present invention has been described in reference to the illustrated embodiments, it is expected that various modifications in addition to those mentioned above will occur to those skilled in the art. For example, a linkage/scale combination as described herein could be retrofitted to a conventional hollow grinding machine, or a different means of clamping the tool-rest could be used. Thus, it will be understood that mechanisms incorporating these and other modifications may fall within the scope of this invention, which is defined by the appended claims.

What is claimed is:

1. A bevel angle control mechanism for a grinding wheel supported for rotation about an axis, comprising:

a tool-rest having a tool support surface oriented at a bevel angle with respect to a grinding surface of said grinding wheel;

a movable linkage mechanism supporting said tool-rest, such linkage mechanism being pivotally adjustable about said axis to achieve a desired bevel angle of said tool support surface with respect to said grinding surface while maintaining a prescribed and coordinated height and attitude adjustment of said tool-rest with respect to said axis;

a pointer indicating a rotary position of said linkage mechanism; and a scale fixed with respect to said axis, and having indicia defining a relationship between a radius of said grinding wheel and said bevel angle for different positions of said linkage mechanism, said pointer cooperating with said scale to indicate the achieved bevel angle.

2. The bevel angle control mechanism of claim 1, wherein said linkage mechanism is also pivotally adjustable about a fixed pivot point linearly displaced from said axis.

3. The bevel angle control mechanism of claim 2, wherein said linkage mechanism comprises a first link pivotally adjustable about said axis, a second link pivotally adjustable about said pivot point, and a third link coupling the first and second links, the tool-rest being supported on a shaft coupling said first and third links.

4. The bevel angle control mechanism of claim 1, wherein said scale indicia include contour lines of constant bevel angle, and the pointer is adjustable so that a tip thereof indicates said radius of said grinding wheel, the achieved bevel angle being indicated by an intersection between said pointer tip and a contour line corresponding to said bevel angle.

5. A hollow grinder comprising:

a grinding wheel;

a support mechanism supporting said grinding wheel about an axis of rotation;

a tool-rest positioned to support a tool blade with respect to a grinding surface of said grinding wheel;

a positionable linkage mechanism supporting said tool-rest and pivotally adjustable about a first point fixed with respect to said support mechanism and coinciding with said axis of rotation so as to achieve a bevel angle of tool blade with respect to said grinding surface while restricting positioning of said tool-rest to a prescribed height and attitude relationship with respect to said axis of rotation;

a pointer indicating a position of said linkage mechanism; and a scale fixed with respect to said support mechanism, and having contour lines of constant bevel angle that are a function of said prescribed relationship and a radius of said grinding wheel, said pointer cooperating with said scale to indicate the achieved bevel angle.

6. The hollow grinder of claim 5, wherein said linkage mechanism is also pivotally adjustable about a second point fixed with respect to said support mechanism and linearly displaced from said axis of rotation.

7. The hollow grinder of claim 6, wherein said linkage mechanism comprises a first link pivotally adjustable about said first point, a second link pivotally adjustable about said second point, and a third link coupling the first and second links, the tool-rest being supported on a shaft coupling said first and third links.

8. The hollow grinder of claim 8, wherein the pointer is adjustable so that a tip thereof indicates said radius of said grinding wheel, the achieved bevel angle being indicated by an intersection between said pointer tip and a contour line corresponding to said bevel angle.

9. The hollow grinder of claim 5, further comprising:

a fluid containing trough fixed with respect to said support mechanism and having an arcuate periphery that envelopes a lower portion of said grinding wheel so that said grinding surface passes through the fluid as the grinding wheel rotates about said axis of rotation;

a tongue element shaped to match the arcuate periphery of said trough, the tongue element being coupled to said linkage mechanism and supported by a clamp member that positions said tongue element adjacent to the periphery of said trough; and a user operated member engaging the clamp member and movable to force said tongue element against the periphery of said trough to thereby lock the position of said linkage mechanism with respect to said support mechanism.

10. The hollow grinder of claim 9, wherein said user operated member is an eccentric cam supported in a housing of said grinder for rotation by the user.

* * * * *